United States Patent [19]

Olsson

[11] Patent Number: 4,636,023

[45] Date of Patent: Jan. 13, 1987

[54] ELECTRICAL CONNECTOR WITH STRAIN RELIEF

[75] Inventor: Billy E. Olsson, New Cumberland, Pa.

[73] Assignee: AMP Incorporated, Harrisburg, Pa.

[21] Appl. No.: 718,148

[22] Filed: Apr. 1, 1985

[51] Int. Cl.[4] ..... H01R 13/58

[52] U.S. Cl. ..... 339/103 M; 339/105

[58] Field of Search ..... 339/17 F, 97 R–99, 339/103 R, 105, 103 M

[56] References Cited

U.S. PATENT DOCUMENTS

| | | | |
|---|---|---|---|
| 3,103,399 | 9/1963 | Martin | 339/105 X |
| 4,160,575 | 7/1979 | Schraut | 339/103 M |
| 4,211,462 | 7/1980 | Wolfthal | 339/99 R |

*Primary Examiner*—Eugene F. Desmond

*Attorney, Agent, or Firm*—Robert W. J. Usher

[57] ABSTRACT

A connector housing wall is formed with a well (20) extending to a cable receiving cavity (15) and a stuffer strip (23) is mounted in the well (20) in an interference fit. The stuffer strip (23) has a bulbous cable engaging face (24), a recessed opposite face (25) and latching shoulders (26) extending along opposite longitudinal edges of the stuffer strip (23) between the faces (24 and 25). The strip (23) can be forced down the well (20) from a cable admitting condition to a cable clamping condition in which the cable engaging face (24) is latched in compressive engagement with the cable (34) by the shoulders (26) being seated under front and rear walls (21 and 22) of the well (20).

6 Claims, 6 Drawing Figures

ELECTRICAL CONNECTOR WITH STRAIN RELIEF

The invention relates to electrical connectors having housings which both accommodate terminals terminating a series of closely spaced insulated conductors and provide strain relief for the terminations.

More particularly, the invention concerns connectors intended for use in the data or telecommunications industries and commonly known as modular plugs in which a series of very closely spaced terminals terminate a series of conductors received in front leading ends of connector housing cavities, such conductors being part of a cable extending into the cavities through mouths formed at the rear ends of the housings.

Such connectors are of very small size in relation to the number of terminations and yet must be robust to permit repeated unplugging by hand which may involve tensile stress being imposed on the cable by the casual user. In addition, as the cables hang freely in an office or domestic environment or are connected to a telephone handset, considerable stress is imposed on the cord as a result of cord snagging or the user dropping the handset.

In a prior, widely used connector such as that described in U.S. Pat. No. 4,002,392, a wall of the housing defining the cavity is formed with a well extending transversely of the cavity axis and a stuffer member comprising a portion of the housing integrally joined by a web to a side of the well is pivotable down the well from an initial wire admitting position located in the well to a final wire clamping position projecting into the cavity into clamping engagement with a cord received therein to provide strain relief.

One side of the stuffer member remains integrally joined by a web to a front wall of the well in the final, wire clamping position and the opposite side is adapted to snap lock under a lip under the rear wall of the well with residual compression of the stuffer member.

Although, the provision of the stuffer member integrally formed with the housing enables the housing to be moulded in one piece, the asymmetrical structure of the stuffer member and the requirement for one side of the stuffer member to remain integrally joined to the well wall by the web in the cable clamping position is disadvantageous in that an imbalance is produced in the stresses imposed on the stuffer member in the cable clamping position.

In addition, the web is relatively weak and may occasionally break with possible consequential dislocation of the stuffer member and deterioration or loss of the cable clamping force.

Furthermore, in view of the precision required in the pivotal movement to the clamping position, the depth of penetration of the cable by the stuffer member cannot be controlled to permit effective clamping of cables of different sizes either as preselected by the operator or arising from manufacturing tolerances in the cable.

According to one aspect of the invention, there is provided an electrical connector including a housing moulded from insulating material with a wall defining a cable receiving cavity extending between front and rear ends of the housing and opening at a cable admitting mouth at the rear end, a well extending through the housing wall to the cavity, a stuffer strip moulded from resilient material with a bulbous cable engaging face and a recessed opposite face, latching shoulders extending along opposite longitudinal edges of the stuffer strip between the faces, the stuffer strip being retained in the well with the edges engaging front and rear walls of the well in an interference fit in a cable admitting condition of the connectors and forcibly movable down the well into a cable clamping condition in which the cable engaging face is in compressive engagement with a cable admitted into the cavity and the shoulders latch with a snap action under front and rear walls of the well.

Preferably the cable engaging face of the stuffer strip tapers symmetrically to an apex extending longitudinally of the strip, which taper maybe formed by a pair of convex surfaces extending between the apex and the opposite edges.

In the connector of the invention, a symmetrical distribution of the forces on each shoulder is obtained assuring stable retention of the stuffer in position. In addition, the predominant clamping forces are located adjacent the center line or apex of the stuffer strip avoiding overstress of the shoulders which would tend to dislodge the stuffer strip.

When seated against the cable, the cable engaging face is symmetrically deformed to define a pair of longitudinally extending concave surfaces which further assist in cable retention and concentration of forces adjacent the centerline of the stuffer strip.

The stuffer strip may economically be moulded as a continuous extrusion and cut to desired length. The substitution of strips of different thicknesses manufactured simply by altering the extrusion die size may enable a range of cable sizes to be accommodated without a need to alter the complex housing mould of the prior art.

Examples of the invention will now be described with reference to the accompanying drawings in which.

Figure 1:
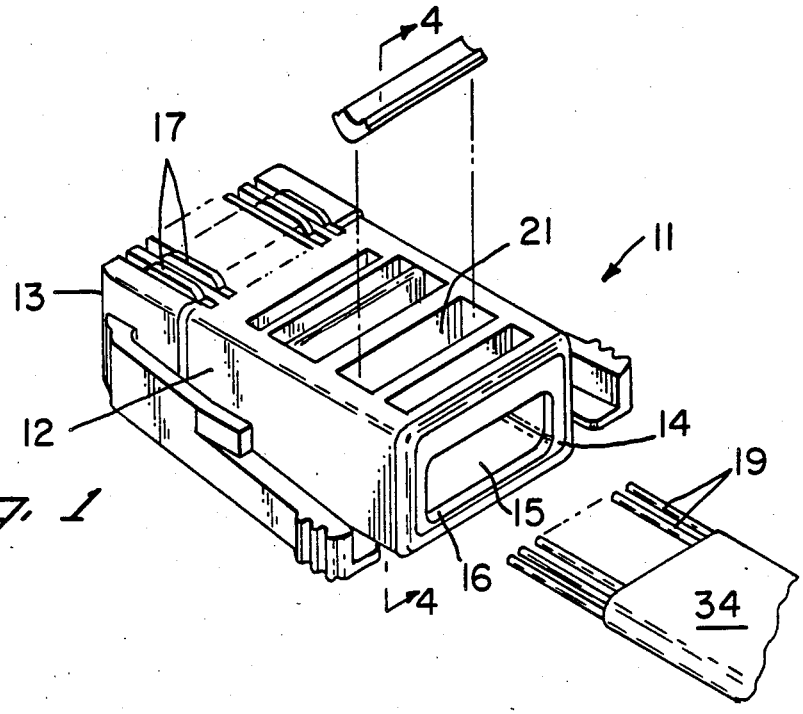
FIG. 1 is a perspective view of an electrical connector according to the invention with a stuffer member exploded from the connector for clarity.
Figure 2:
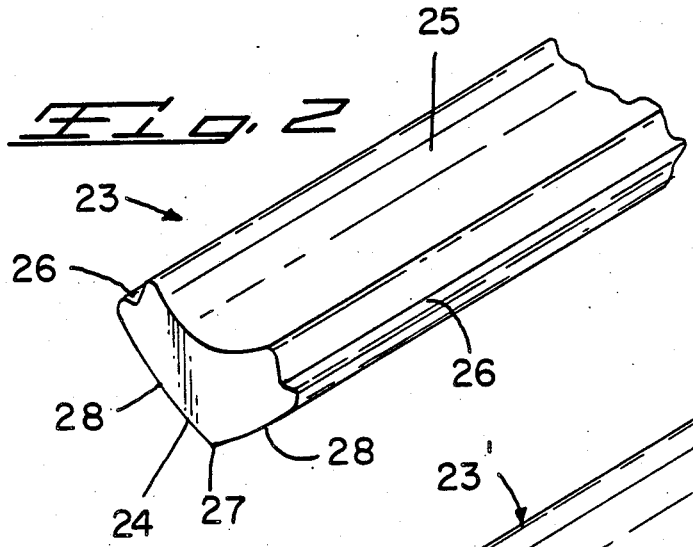
FIG. 2 is a perspective view of a first example of stuffer member.
Figure 3:
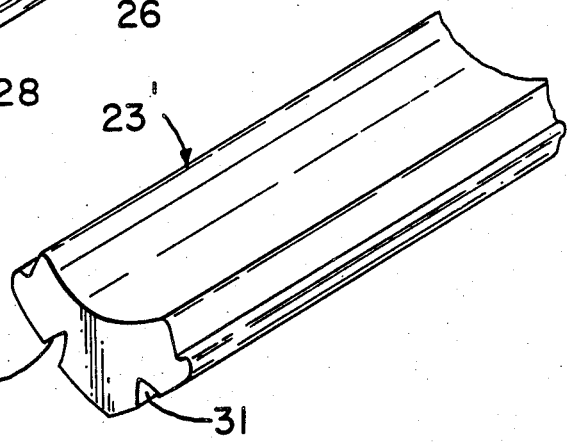
FIG. 3 is a similar view of FIG. 2 but of a second example of stuffer member.

The connector 11 comprises a plug housing 12 having front and rear ends 13 and 14, respectively, the housing walls defining a wire-receiving cavity 15 extending forwardly from a wire admitting mouth 16 at the rear end to the front end. A series of closely spaced blade-form contacts 17 are preloaded in the housing at the front end for termination of insulated conductors 19 of a cable when received in the cavity. The connector, as described above, is of well known type similar to that described in U.S. Pat. No. 4,458,973 to which reference is hereby directed.

Figure 4:
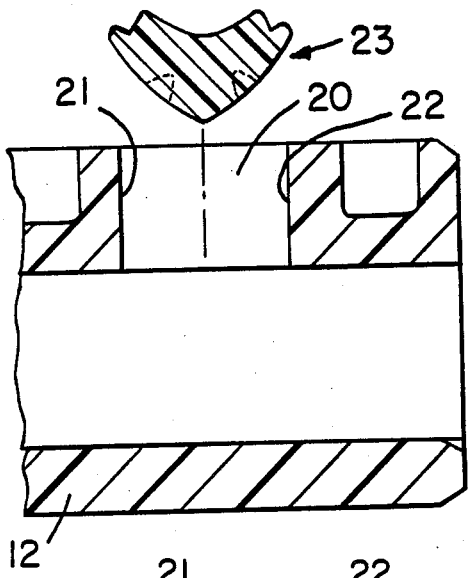
FIG. 4 is a fragmentary cross-sectional view of the rear of the connector taken along line 4–4 of FIG. 1.
Figure 5:
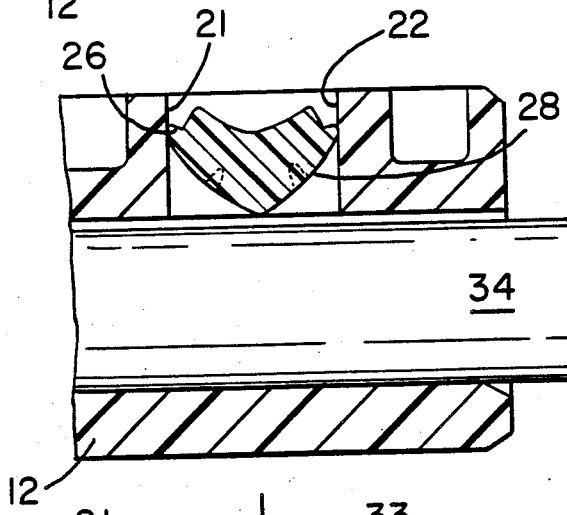
FIG. 5 is a similar view to FIG. 4 with the stuffer member preloaded in the connector housing.
Figure 6:
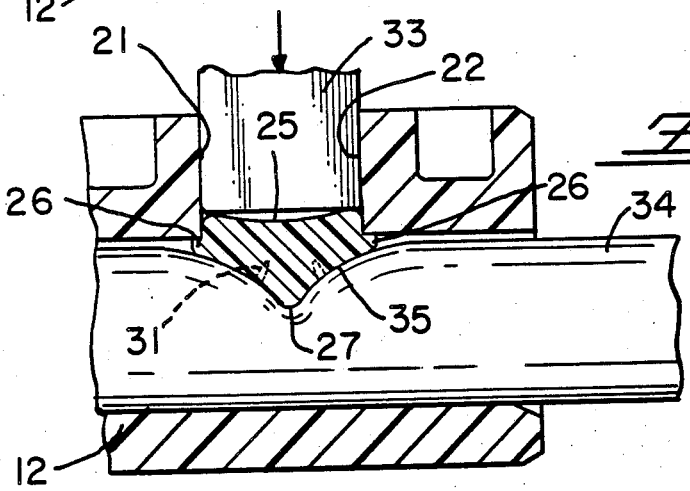
FIG. 6 is a similar view of FIG. 5 but with the stuffer member in clamping engagement with a cable.

A well 20 having front and rear walls 21 and 22, respectively, extends through an upper cable portion of the housing into communication with the cavity, as seen in FIGS. 4–6.

A stuffer strip 23 is moulded from resilient plastics material, possibly by extrusion, and comprises a bulbous wire engaging face 24 opposite a rear face formed with a longitudinally extending recess 25. Opposite longitudinal edges of the strip are formed with shoulders 26 extending between the faces. The wire engaging face tapers symmetrically towards an apex 27 and comprises a pair of convex surfaces 28 which extend between the apex and the edges of the strip.

The strip 23' shown in FIGS. 3-6 is modified by the formation of stress relieving grooves 31 extending longitudinally of the strip on respective opposite sides of the apex.

As shown in FIG. 5, in the cable admitting condition, the strip 23 is preloaded as an interference fit in the well with the shoulders 26 engaging front and rear walls, entry of the strip being facilitated by the contraction of the grooves 31. The stress produced in the wire engaging face of the strip may be relieved by lateral expansion of the grooves, if provided.

As shown in FIG. 6, the strip is driven down the well to the cable clamping condition by a simple ram 33 which drives the cable engaging face against the cable 34 at the same time as the termination ram engages the terminals. During the final stages of movement the shoulders seat with a positive snap action under the front and rear walls of the well enhanced as the strip is squeezed between the ram and the cable. The cable engaging face is deformed by the compressive forces to define a pair of concave surfaces 35,35' extending between the apex and the strip edges.

The symmetrical distribution of the forces on each shoulder assures the stable retention of the stuffer in position. In addition, as the maximum clamping forces are located adjacent the apex, any tendency to overstress the shoulders is avoided. The desirable concave cable engaging surface portions are formed largely as a result of the stress relief permitted by resilient deformation of the rear face enabled by the recess, the ram force being applied to opposite edge portions of the face adjacent the shoulders.

In some versions of the stuffer strip, the bulbous cable engaging face may comprise a pair of the flat rather than convex surfaces extending between the apex and the strip edges.

I claim:

1. An electrical connector including a housing moulded from insulating material with a wall defining a cable receiving cavity extending between front and rear ends of the housing and opening at a cable admitting mouth at the rear end, a well extending through the housing wall to the cavity, a stuffer strip moulded from resilient material with a bulbous cable engaging face and a recessed opposite face, the cable engaging face of the stuffer strip having a pair of surfaces tapering symmetrically from respective longitudinal edges to an apex extending longitudinally of the strip, latching shoulders extending along opposite longitudinal edges of the stuffer strip between the faces, the stuffer strip being retained in the well with the edges engaging front and rear walls of the well in an interference fit in a cable admitting condition of the connector and forcibly movable down the well into a cable clamping condition in which the cable engaging face is in compressive engagement with a cable admitted into the cavity and abutting a wall of the cavity below the well and the shoulders latch with a snap action under front and rear walls of the well, the surfaces forming the taper being deformed inwardly into a concave configuration by engagement with the cable.

2. An electrical connector according to claim 1 in which the pair of surfaces forming the taper are convex prior to their deformation by engagement with the cable.

3. An electrical connector according to claim 1 in which the cable engaging face is formed with a pair of stress relieving grooves extending longitudinally of the strip on respective opposite sides of the apex.

4. A stuffer strip moulded from resilient material with a cable engaging face and a rear face, latching shoulders extending along opposite longitudinal edges of the strip between the faces, the cable engaging face having a pair of cable engaging surfaces extending from the respective edges and tapering symmetrically to an apex extending longitudinally of the strip, a stress relieving groove extending along the cable engaging face on each side of the apex, and the rear face being formed with a longitudinally extending stress relieving recess, the opposite surfaces of the cable being inwardly deformable into a concave configuration by pressing the cable engaging face against a cable with a consequent reduction in the depth of the recess.

5. A stuffer strip according to claim 4 in which the pair of surfaces forming the taper are convex.

6. An electrical connector including a housing moulded from insulating material with a wall defining a cable receiving cavity extending between front and rear ends of the housing and opening at a cable admitting mouth at the rear end, a well extending through the wall to the cavity, a stuffer strip moulded from resilient material with a cable engaging face and a rear face, latching shoulders extending along opposite longitudinal edges between the faces, the stuffer strip being retained in resiliently compressed condition against a cable in the cavity in abutment with a wall of the cavity below the well by the shoulders seated under front and rear walls of the well with the rear face received in the well and the cable engaging face defining a pair of surfaces tapering symmetrically from respective longitudinal edges towards an apex extending longitudinally of the stuffer strip, and deformed inwardly into a concave configuration by engagement with the cable.

* * * * *